US009250606B2

(12) United States Patent
Takagi et al.

(10) Patent No.: US 9,250,606 B2
(45) Date of Patent: Feb. 2, 2016

(54) DRUM UNIT

(75) Inventors: Takeyuki Takagi, Nagoya (JP); Fumio Morita, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 358 days.

(21) Appl. No.: 13/073,136

(22) Filed: Mar. 28, 2011

(65) Prior Publication Data

US 2011/0311270 A1 Dec. 22, 2011

(30) Foreign Application Priority Data

Jun. 17, 2010 (JP) ..... 2010-138025

(51) Int. Cl.

| | |
|---|---|
| ***G03G 15/08*** | (2006.01) |
| ***G03G 21/18*** | (2006.01) |
| ***G03G 21/16*** | (2006.01) |
| ***G03G 15/00*** | (2006.01) |

(52) U.S. Cl.

CPC ..... *G03G 21/1821* (2013.01); *G03G 15/751* (2013.01); *G03G 21/1619* (2013.01); *G03G 21/1832* (2013.01); *G03G 2221/1648* (2013.01); *G03G 2221/1678* (2013.01)

(58) Field of Classification Search

CPC ..... G03G 15/5008; G03G 15/757
USPC ..... 399/102, 117
See application file for complete search history.

(56) References Cited

U.S. PATENT DOCUMENTS

| | | | | |
|---|---|---|---|---|
| 5,502,547 | A * | 3/1996 | Shirai | 399/102 |
| 5,559,581 | A * | 9/1996 | Sugiura et al. | 399/111 |
| 5,722,013 | A * | 2/1998 | Nagase et al. | 399/112 |
| 6,002,897 | A * | 12/1999 | Kohno et al. | 399/117 |
| 6,006,056 | A | 12/1999 | Hagiwara et al. | |
| 6,067,429 | A * | 5/2000 | Sugaya et al. | 399/167 |
| 7,184,685 | B2 | 2/2007 | Sato | |
| 8,068,767 | B2 | 11/2011 | Kamimura et al. | |
| 2002/0149664 | A1 * | 10/2002 | Nagamine et al. | 347/138 |
| 2004/0190935 | A1 | 9/2004 | Sato | |
| 2007/0065177 | A1 | 3/2007 | Yamashita et al. | |
| 2007/0253729 | A1 | 11/2007 | Takagi | |
| 2008/0101817 | A1 * | 5/2008 | Oda et al. | 399/102 |

(Continued)

FOREIGN PATENT DOCUMENTS

| | | |
|---|---|---|
| CN | 1534395 A | 10/2004 |
| JP | 08-030057 | 2/1996 |

(Continued)

OTHER PUBLICATIONS

Notification of Reasons for Refusal for corresponding Japanese Patent No. 2010-138025 dtd Apr. 24, 2012.

(Continued)

*Primary Examiner* — Benjamin Schmitt

(74) *Attorney, Agent, or Firm* — Banner & Witcoff, Ltd.

(57) ABSTRACT

A drum unit is provided. The drum unit includes a frame, a photosensitive drum that is rotatably supported by the frame, a contact member that is held to the frame and that contacts a circumferential surface of the photosensitive drum. The circumferential surface of the photosensitive drum has an image forming area on which an electrostatic latent image is formed and a non-image forming area that is adjacent to the image forming area. The contact member is in surface-contact with the non-image forming area and is not contacting with the image forming area.

15 Claims, 7 Drawing Sheets

(56) References Cited

U.S. PATENT DOCUMENTS

| | | | |
|---|---|---|---|
| 2009/0169253 | A1 | 7/2009 | Kamimura et al. |
| 2012/0014716 | A1 | 1/2012 | Kamimura et al. |

FOREIGN PATENT DOCUMENTS

| | | |
|---|---|---|
| JP | 10-143048 | 5/1998 |
| JP | 10-340029 | 12/1998 |
| JP | 2000-047527 | 2/2000 |
| JP | 2000-088013 | 3/2000 |
| JP | 2001-209272 | 8/2001 |
| JP | 2004-302004 | 10/2004 |
| JP | 2007-086313 | 4/2007 |
| JP | 2007-316631 | 12/2007 |
| JP | 2009-162913 | 7/2009 |

OTHER PUBLICATIONS

Chinese Office Action received in corresponding Chinese Application No. 201110078893.8 mailed Jun. 20, 2013.

* cited by examiner

DRUM UNIT

CROSS-REFERENCE TO RELATED APPLICATION

This application claims priority from Japanese Patent Application No. 2010-138025, filed on Jun. 17, 2010, the entire subject matter of which is incorporated herein by reference.

TECHNICAL FIELD

Aspects of the present invention relate to a drum unit that is provided in an image forming apparatus such as a laser printer.

BACKGROUND

According to an example of an image forming apparatus, such as laser printer, a drum unit that holds a photosensitive drum is detachably mounted to a main body of the apparatus.

The photosensitive drum has a cylindrical hollow drum main body and a drum shaft extending along a central axis line of the drum main body. The drum shaft is held to a frame of a drum unit so that it cannot be rotated. The drum main body is rotatably supported to the drum shaft. A flange is fitted to one end portion of the drum main body and a drum gear is connected to the other end portion thereof. When driving force of a motor is input to the drum gear, the photosensitive drum (drum main body) is rotated in a predetermined direction.

A developing unit that holds a developing roller is mounted to the frame. When the developing unit is mounted to the frame, the developing roller is pressure-contacted to the drum main body. While being pressure-contacted to the drum main body, the developing roller is rotated in a reverse direction with respect to a rotating direction of the photosensitive drum so that a part pressure-contacted to the drum main body is moved in the same direction as a surface of the drum main body. As the photosensitive drum and the developing roller are rotated, toner is supplied to the surface of the drum main body from the developing roller and an electrostatic latent image formed on the surface of the drum main body is developed into a toner image. In addition, a transfer roller is opposed to the drum main body. While opposed to the transfer roller, the toner image carried on the surface of the drum main body is transferred to a sheet that is introduced between the transfer roller and the drum main body.

A rotational speed of the drum main body should be kept to be constant during an image forming operation. In other words, when the rotational speed of the drum main body is changed, the electrostatic latent image formed on the surface of the drum main body is expanded and contracted and the image (toner image) formed on the sheet is thus expanded and contracted depending on the change, so that a quality of an image formed on the sheet deteriorates.

The rotational speed of the drum main body may be changed due to a disturbance input to the drum main body during the image forming operation. For example, when a leading end of the sheet introduced between the drum main body and the transfer roller contacts the surface of the drum main body, the surface of the drum main body is pushed by the leading end of the sheet and the drum main body may be thus encouraged to rotate. Thereby, the rotational speed of the drum main body is changed (increased).

In order to suppress the change in the rotational speed of the drum main body, a braking member is pressed for the flange fitted to the drum main body from a direction following the drum shaft. Specifically, the braking member is provided for the flange at a position opposite to the direction following the drum shaft, and a press member for pressing the braking member toward the flange is mounted between the braking member and the frame of the drum unit. The braking member is pressure-contacted to the flange by the pressing force of the press member and frictional force is applied to the flange from the braking member, so that the change in the rotational speed of the drum main body is suppressed (for example, see JP-A-2007-316631).

When the braking member and the press member are provided, it is beneficial to increase the pressing force (elastic force) of the press member so as to suppress the change in the rotational speed of the drum main body (so as to exclude the effect of the disturbance input to the drum main body). However, when mounting the photosensitive drum to the drum unit, the braking member should be moved against the pressing force of the press member in a direction away from the frame of the drum unit during the mounting operation. Thus, when the pressing force of the press member is increased, much greater force is required to move the braking member. Therefore, the mounting operability of the photosensitive drum to the frame deteriorates.

SUMMARY

It is an aspect of the present invention to provide a drum unit enabling a photosensitive drum to be easily mounted on a frame and capable of suppressing a change in a rotational speed of the photosensitive drum.

According to an illustrative embodiment of the present invention, there is provided a drum unit comprising: a frame; a photosensitive drum that is rotatably supported by the frame; a contact member that is connected to the frame and that contacts a circumferential surface of the photosensitive drum, wherein the circumferential surface of the photosensitive drum has an image forming area on which an electrostatic latent image is formed and a non-image forming area that is adjacent to the image forming area, and wherein the contact member is in surface-contact with the non-image forming area and is not contacting with the image forming area.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Below illustrative embodiments of the invention will be specifically described with reference to the accompanying drawings.

1. Laser Printer

Figure 1:
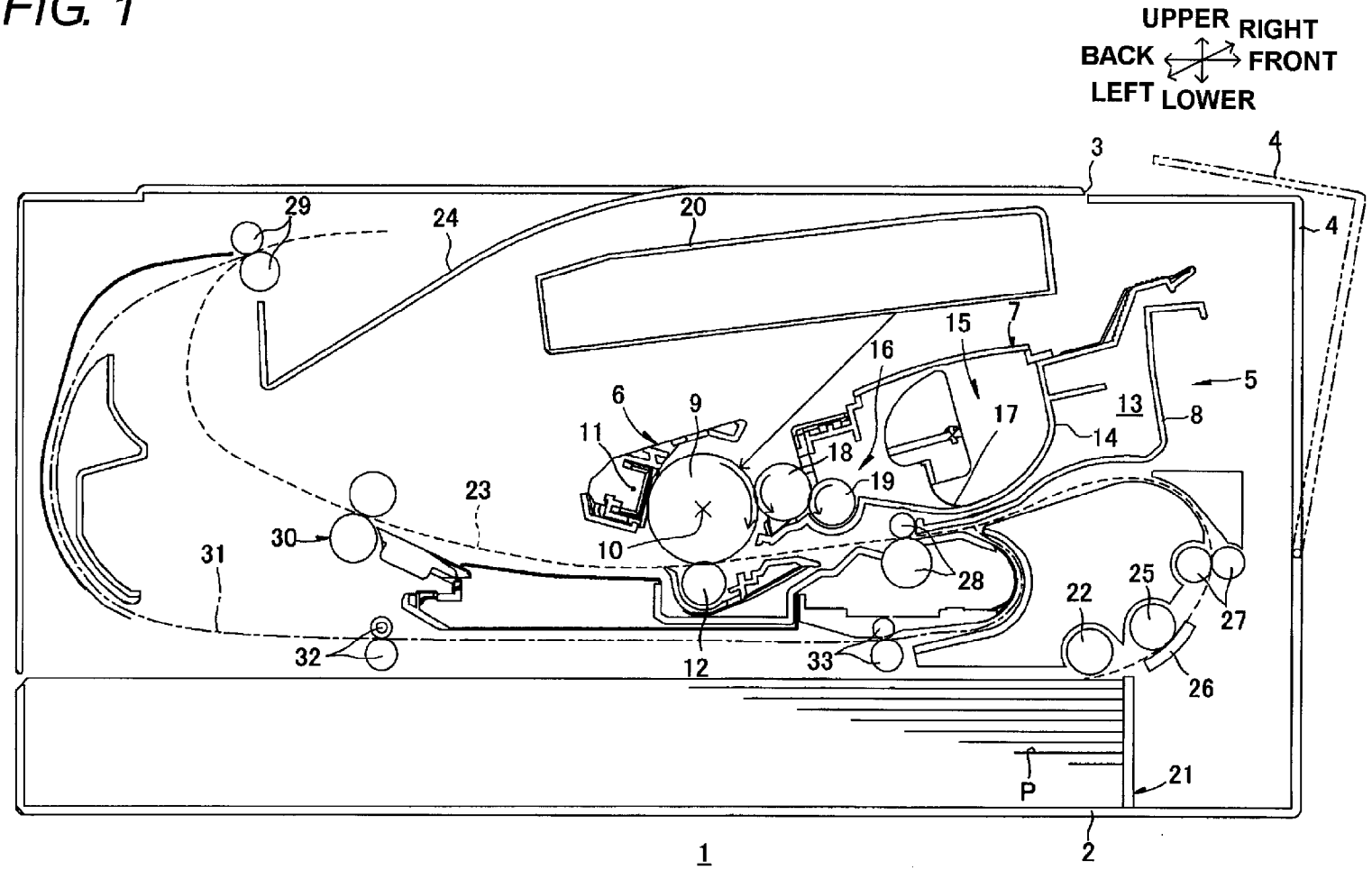
FIG. 1 is a sectional view of a laser printer to which a drum unit according to an illustrative embodiment of the invention is mounted.

As shown in FIG. 1, a laser printer 1 that is an example of an image forming apparatus has a body casing 2 that is an example of a main body of the apparatus. One sidewall of the body casing 2 is formed with a cartridge attaching and detaching port 3 and is provided with a front cover 4 that opens and closes the cartridge attaching and detaching port 3.

In the meantime, a side (a right side of FIG. 1) at which the front cover 4 is provided is referred to as a front side of the laser printer 1. In addition, the upper, lower, left and right are set when seen from the front side of the laser printer 1. Further, a drum unit 7 will be described based on directions when the drum unit 7 is mounted in the body casing 2, unless otherwise described.

A process unit 5 is mounted at a slightly more forward position than a center in the body casing 2. The process unit 5 is mounted into the body casing 2 and detached from the body casing 2 through the cartridge attaching and detaching port 3 when the front cover 4 is opened.

The process unit 5 includes a drum unit 6 and a developing unit 7 that is detachably mounted to the drum unit 6.

The drum unit 6 has a frame 8. A photosensitive drum 9 is held at a rear end portion of the frame 8 so that it can be rotated about a rotational axis line 10 extending leftward and rightward. In addition, the frame 8 holds a charger 11 and a transfer roller 12. The charger 11 and the transfer roller 12 are arranged at rear and lower sides of the photosensitive drum 9, respectively.

A part of the frame 8 located more forward than the photosensitive drum 9 is a developing unit mounting part 13 and the developing unit 7 is mounted to the developing unit mounting part 13.

The developing unit 7 has a housing 14 that accommodates toner. In the housing 14, a toner accommodating chamber 15 and a developing chamber 16, which communicate with each other, are formed to be adjacent in a front-back direction.

The toner accommodating chamber 15 is provided therein with an agitator 17 so that the agitator can be rotated about an agitator rotational axis line extending leftward and rightward. When the agitator 17 is rotated, toner accommodated in the toner accommodating chamber 15 is stirred and supplied from the toner accommodating chamber 15 to the developing chamber 16.

The developing chamber 16 is provided therein with a developing roller 18 and a supply roller 19 so that the developing roller and the supply roller can be rotated about a developing roller rotational axis line and a supply roller rotational axis line extending leftward and rightward, respectively. The developing roller 18 is arranged so that a part of a circumferential surface thereof is exposed from a rear end portion of the housing 14. The developing unit 7 is mounted to the drum unit 6 so that the circumferential surface of the developing roller 18 contacts a circumferential surface of the photosensitive drum 9. The supply roller 19 is arranged so that a circumferential surface thereof contacts the circumferential surface of the developing roller 18 from a front-lower side. The toner in the developing chamber 15 is supplied to the circumferential surface of the developing roller 18 by the supply roller 19 and is carried, as a thin layer, on the circumferential surface of the developing roller 18.

Additionally, in the body casing 2, an exposure device 20 having a laser and the like is arranged above the process unit 5.

When forming an image, the photosensitive drum 9 is rotated at a constant speed in a clockwise direction of FIG. 1. As the photosensitive drum 9 is rotated, the circumferential surface of the photosensitive drum 9 is uniformly charged by discharges from the charger 10. Meanwhile, a laser beam is emitted from the exposure device 20 based on image data received from a personal computer (not shown) connected to the printer 1. The laser beam passes between the charger 10 and the developing unit 7 and irradiates the circumferential surface of the photosensitive drum 9 that is uniformly and positively charged, thereby selectively exposing the circumferential surface of the photosensitive drum 9. Thus, charges are selectively removed from the exposed part of the photosensitive drum 9, so that an electrostatic latent image is formed on the circumferential surface of the photosensitive drum 9. When the electrostatic latent image faces the developing roller 18 as the photosensitive drum 9 is rotated, the toner is supplied to the electrostatic latent image from the developing roller 18. Thereby, a toner image is formed on the circumferential surface of the photosensitive drum 9.

A sheet feeding cassette 21 that accommodates a sheet P therein, which is an example of a medium to be transferred, is arranged on a bottom part of the body casing 2. A pickup roller 22 for sending the sheet from the sheet feeding cassette 21 is provided above the sheet feeding cassette 21.

Additionally, a conveyance path 23, which has an S shape when seen from the side face, is formed in the body casing 2. The conveyance path 23 reaches a sheet discharge tray 24 formed at an upper surface of the body casing 2 via a space between the photosensitive drum 9 and the transfer roller 11 from the sheet feeding cassette 21. A separation roller 25 and a separation pad 26, which are arranged to be opposite to each other, a pair of feeder rollers 27, a pair of register rollers 28 and a pair of sheet discharge rollers 29 are all provided along the conveyance path 23.

The sheets P sent from the sheet feeding cassette 21 are handled one by one while passing between the separation roller 25 and the separation pad 26. Then, the sheet P is conveyed toward the register rollers 28 by the feeder rollers 27. Then, the sheet P is registered by the register rollers 28 and then conveyed between the photosensitive drum 9 and the transfer roller 12 by the register rollers 28.

The toner image on the circumferential surface of the photosensitive drum 9 is electrically attracted and transferred on the sheet P by the transfer roller 12 when the toner image faces the sheet P passing between the photosensitive drum 9 and the transfer roller 12 by the rotation of the photosensitive drum 9.

On the conveyance path 23, a photographic fixing device 30 is provided at a downstream side of the conveyance direction of the sheet P with respect to the transfer roller 12. The sheet P on which the toner image is transferred is conveyed through the conveyance path 23 and passes through the photographic fixing device 30. In the photographic fixing device 30, the toner image becomes an image that is then fixed on the sheet P by heating and pressing.

The printer 1 has a one-sided mode, which forms an image (toner image) on one side of the sheet P, and a duplex mode, which first forms an image on one side of the sheet P and then forms an image on the other side of the sheet P, as operation modes.

In the one-sided mode, the sheet P having an image formed on one side thereof is discharged to the sheet discharge tray 24 by the sheet discharge rollers 29.

As a configuration for realizing the duplex mode, the body casing 2 is formed with a reverse conveyance path 31 therein. The reverse conveyance path 31 extends between the conveyance path 23 and the sheet feeding cassette 21 from the vicinity of the sheet discharge rollers 29 and is connected to a part between the feeder rollers 27 and the register rollers 28 on the conveyance path 23. A pair of first reverse conveyance rollers 32 and a pair of second reverse conveyance rollers 33 are provided on the reverse conveyance path 31.

In the duplex mode, the sheet P having an image formed on one side thereof is sent to the reverse conveyance path 31 without being discharged to the sheet discharge tray 24. Then, the sheet P is conveyed through the reverse conveyance path 31 by the first reverse conveyance rollers 32 and the second reverse conveyance rollers 33 and two sides of the sheet are reversed, so that the other side having no image formed thereon is sent to the conveyance path 23 while facing the circumferential surface of the photosensitive drum 9. Then, an image is formed on the other side of the sheet P, so that images are formed on both sides of the sheet P.

2. Drum Unit

Figure 2:
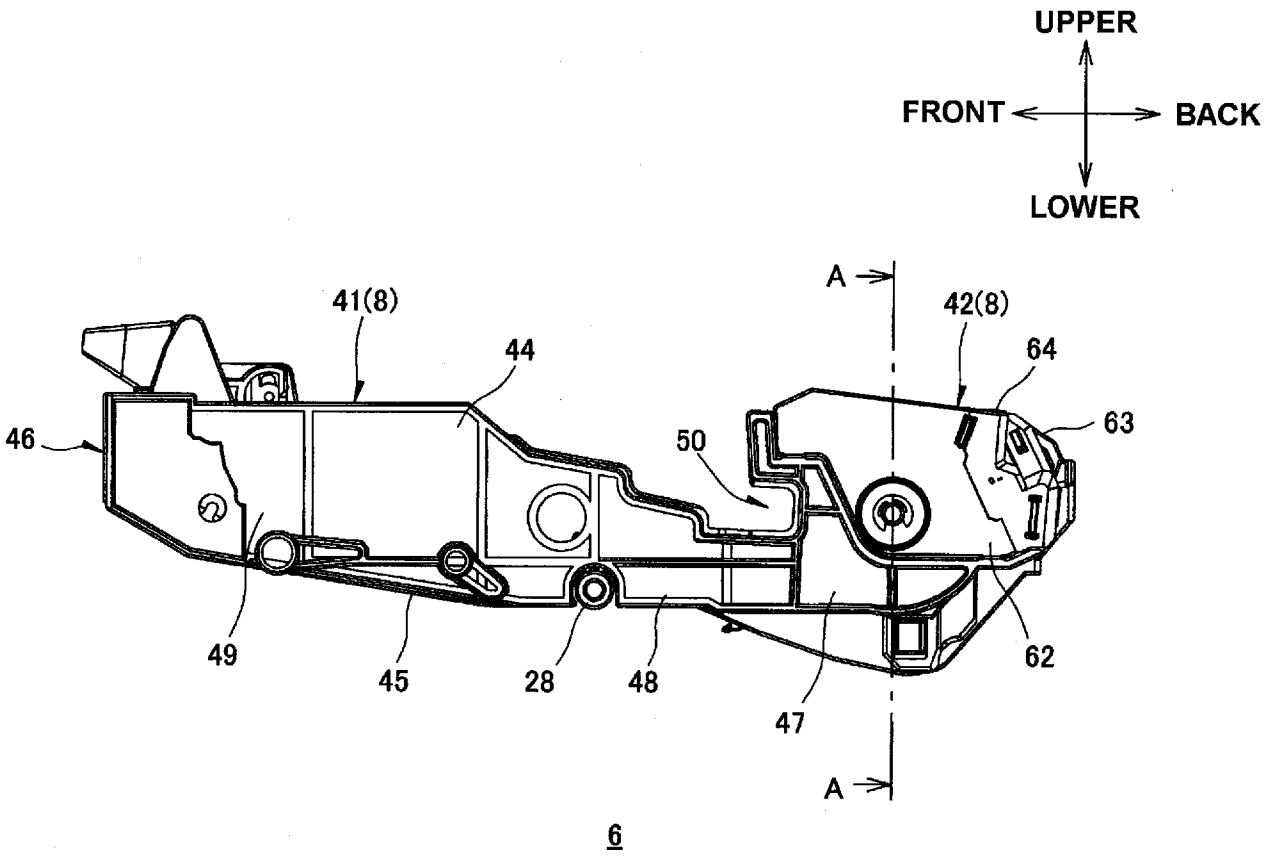
FIG. 2 is a right side view of the drum unit shown in FIG. 1.
Figure 3:
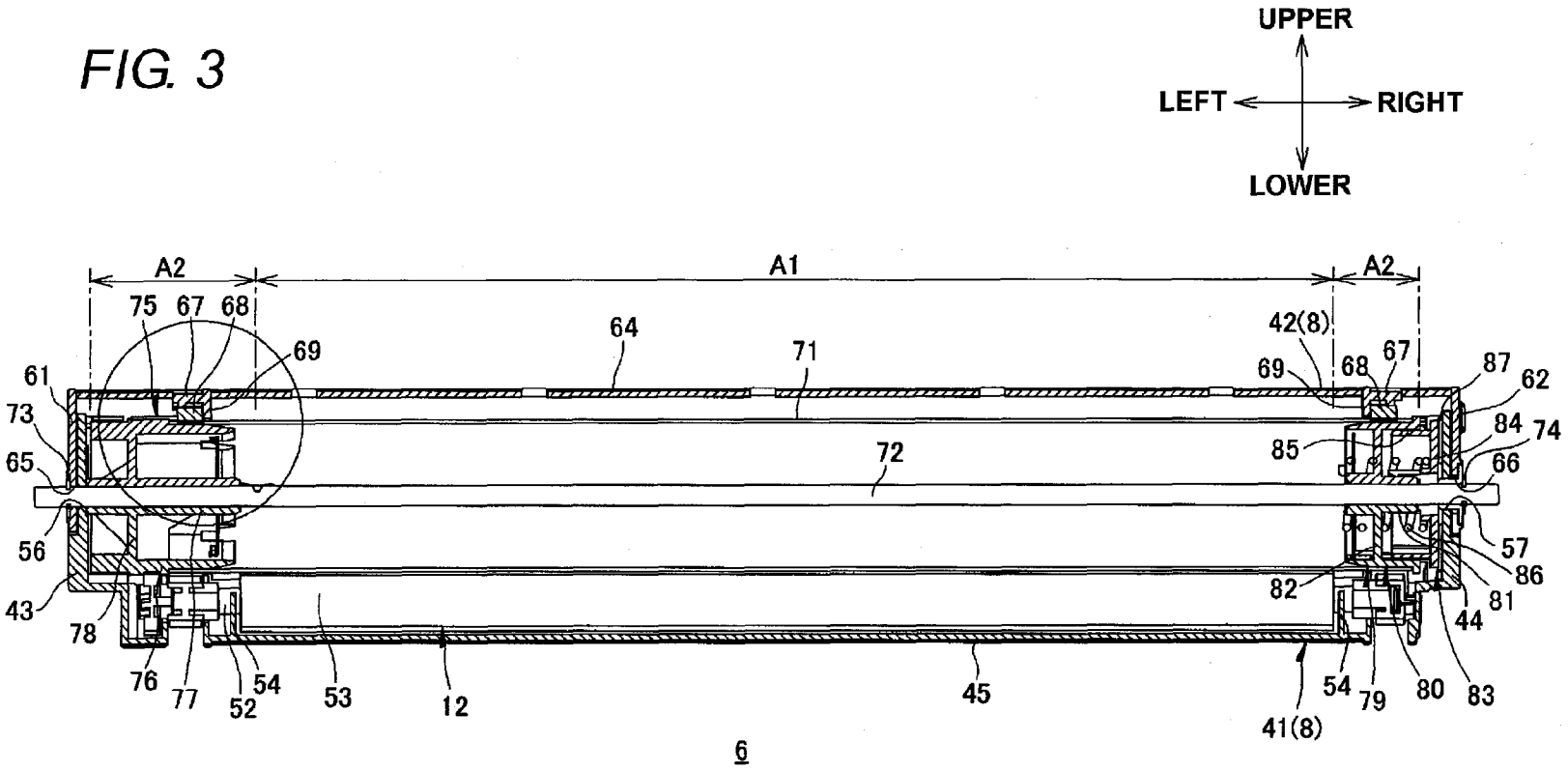
FIG. 3 is a sectional view of the drum unit taken along a line A-A shown in FIG. 2.

As shown in FIGS. 2 and 3, the frame 8 of the drum unit 6 is separated into upper and lower frames. In other words, the frame 8 has a lower frame 41 and an upper frame 42 that is separately formed from the lower frame 41 and is assembled to the lower frame 41 from the upper.

(1) Lower Frame

Figure 5:
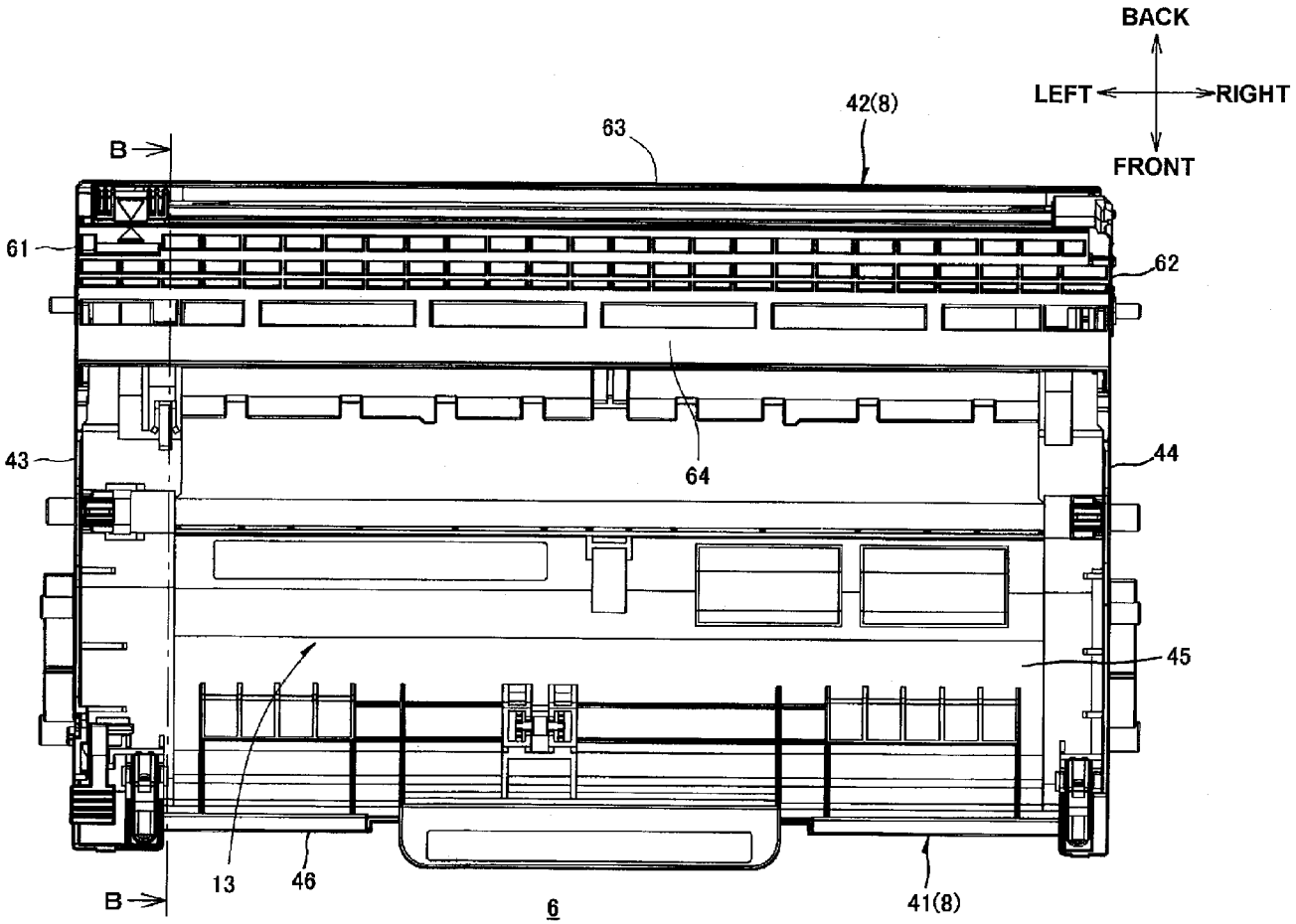
FIG. 5 is a plan view of the drum unit shown in FIG. 1.

As shown in FIG. 5, the lower frame 41 integrally has a left sidewall 43, a right sidewall 44, a bottom wall 45 and a front wall 46.

Figure 6:
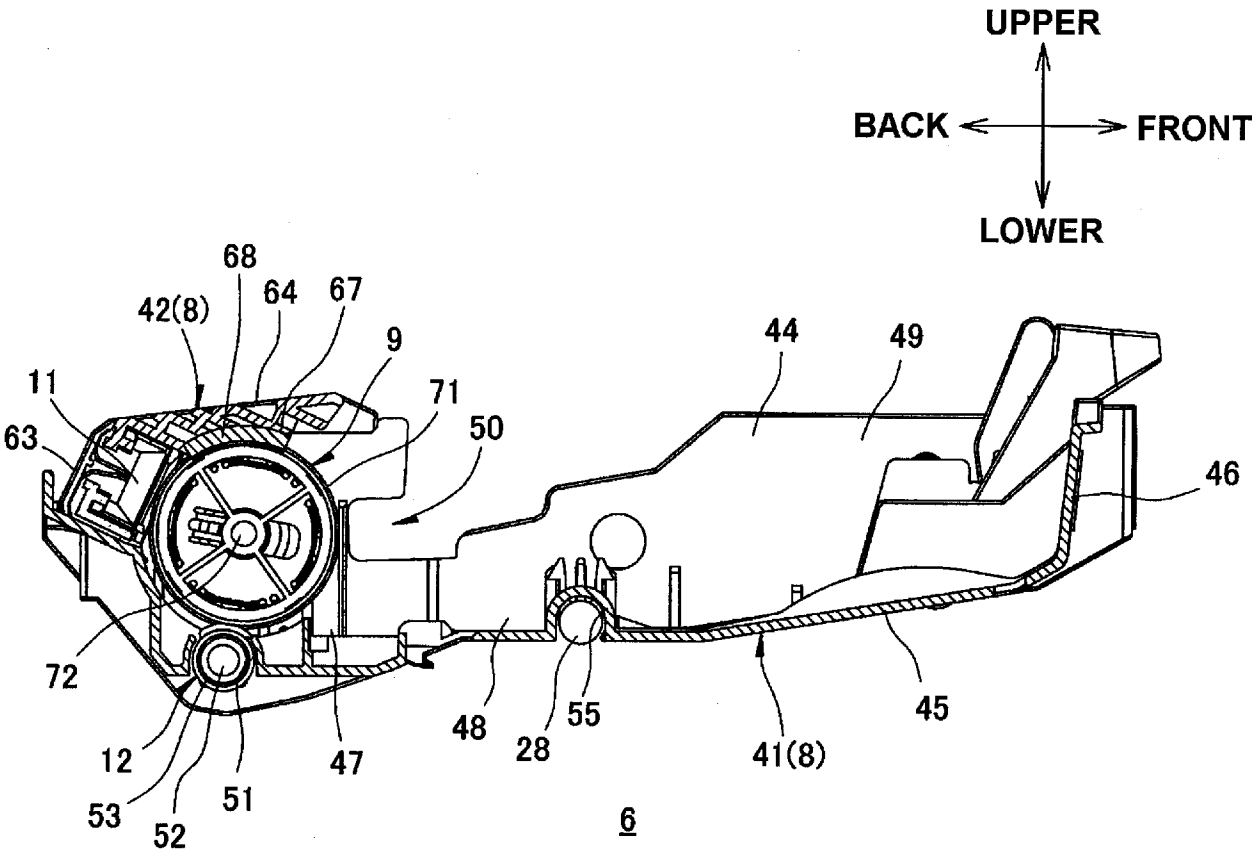
FIG. 6 is a sectional view of the drum unit taken along a line B-B shown in FIG. 5.

The left sidewall 41 and the right sidewall 42 face each other and are separated by an interval in the left-right direction (width direction) and have substantially the same shape, when seen from a side face. As shown in FIG. 6 in which the right sidewall 44 is shown, the left sidewall 43 and the right sidewall 44 include a drum opposing wall part 47, a developing roller guiding wall part 48 and a cartridge opposing wall part 49, respectively.

The drum opposing wall part 47 has a bow shape, when seen from a side face.

The developing roller guiding wall part 48 extends forward from a lower part than a center of a front end edge of the drum opposing wall part 47. An upper end edge of the developing roller guiding wall part 48 extends in the front-upper direction and a width of the upper-lower direction of the developing roller guiding wall part 48 is wider at a front side than at a rear side. A front end portion of the drum opposing wall part 47 is formed with a roller bearing receiving part 50 that receives an end portion of a rotational shaft (not shown) of the developing roller 18, as a recess part that is forward recessed so that a lower end edge of the developing roller guiding wall part 48 continues to an upper end edge thereof.

The cartridge opposing wall part 49 extends forward from a front end edge of the developing roller guiding wall part 48 and has a substantially rectangular shape, when seen from a side face.

The developing unit mounting part 13 is sandwiched between the developing roller guiding wall parts 48 and the cartridge opposing wall parts 49. The rotational shaft of the developing roller 18 is received in the roller bearing receiving part 50 and a rear end portion of the developing unit 7 (refer to FIG. 1) is thus pressed down, so that the developing unit 7 is mounted to the developing unit mounting part 13. When mounting the developing unit 7, the rotational shaft of the developing roller 18 is slid on the developing roller guiding wall part 48, so that the developing roller 18 is smoothly introduced into the roller bearing receiving part 50.

As shown in FIG. 5, the bottom wall 45 has a substantially flat plate shape and is formed to connect lower end edges of the left sidewall 43 and the right sidewall 44. A rear end portion of the bottom wall 45 is formed with a transfer roller receiving part 51 that receives the transfer roller 12, as shown in FIG. 6. Specifically, as shown in FIG. 3, the transfer roller 12 has a transfer roller shaft 52 made of metal and a rubber roller 53 that covers a circumference of the transfer roller shaft 52. As shown in FIG. 6, the transfer roller receiving part 51 has a shape such that an upper end portion of an arc convexly curved upwardly having a semicircular section is cut, and receives the rubber roller 53 with an upper portion of the rubber roller 53 protruding upwardly from the cut portion.

In addition, the rear end portion of the bottom wall 45 is provided with transfer roller support plates 54 at both sides of the transfer roller receiving part 51. The transfer roller support plates 54 supports the transfer roller shaft 52 of the transfer roller 12 from below and are formed to stand. Both end portions of the transfer roller shaft 52 are supported by the transfer roller support plates 54, so that the transfer roller 12 is rotatably mounted.

Furthermore, as shown in FIG. 6, the bottom wall 45 is formed with an arc-shaped register roller receiving part 55, which is convexly curved upwardly and has a semicircular section, at its center portion of the front-rear direction. The register roller 28 is received in the register roller receiving part 55 and is rotatably supported by the left sidewall 43 and the right sidewall 44.

The front wall 46 extends upwardly from the front end edge of the bottom wall 45 and has both end edges that are connected to the left sidewall 43 and the right sidewall 44, respectively.

(2) Upper Frame

Figure 7:
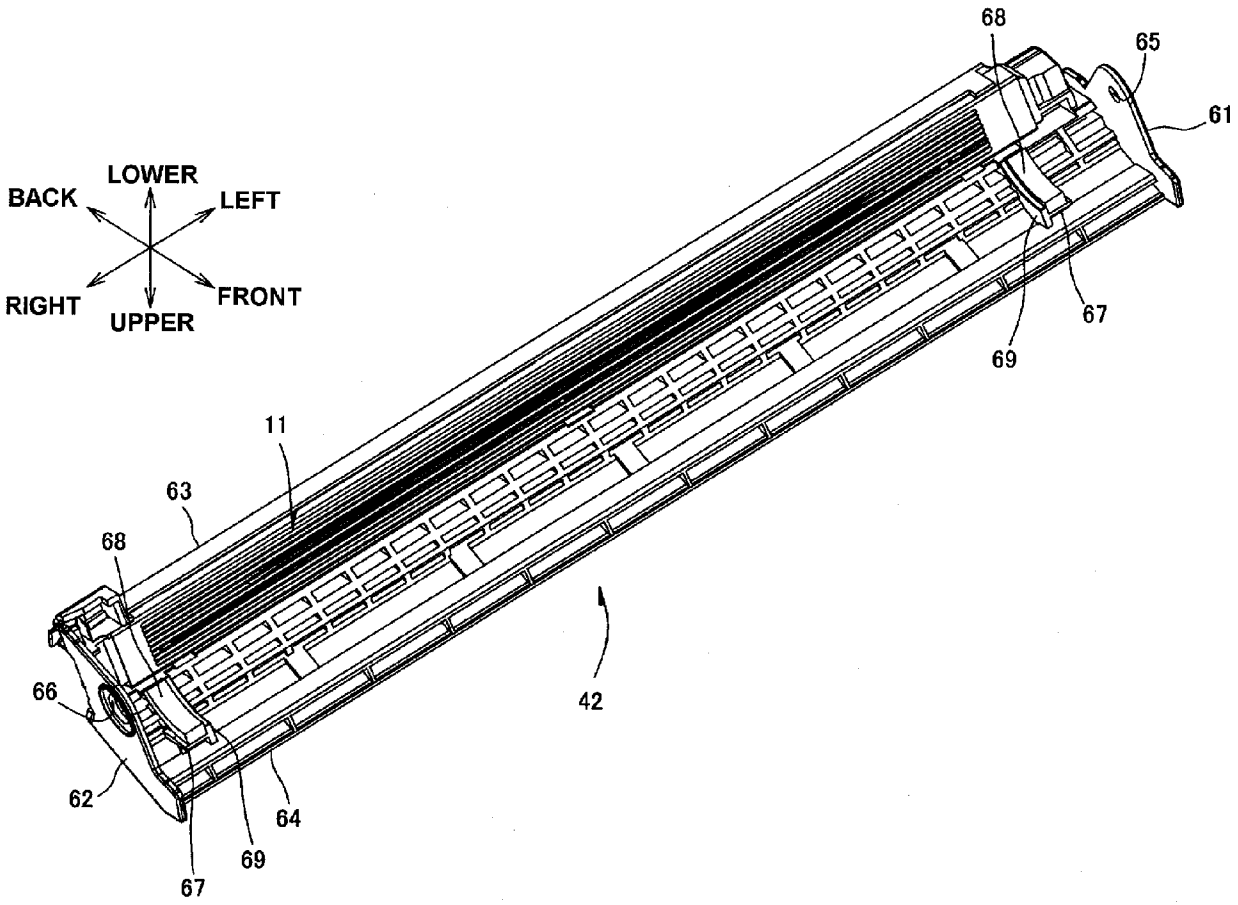
FIG. 7 is a perspective view of an upper frame shown in FIG. 2.

As shown in FIG. 7, the upper frame 42 integrally has a left sidewall 61, a right sidewall 62, a rear wall 63 and a ceiling wall 64 that is an example of a wall part.

The left sidewall 61 and the right sidewall 62 are opposed to each other across an interval in the left-right direction (width direction). As shown in FIG. 3, when the upper frame 42 is assembled to the lower frame 41, the left sidewall 61 and the right sidewall 62 are opposed to the drum opposing wall parts 47 of the left sidewall 43 and the right sidewall 44 from the outside, respectively. Specifically, an upper portion of each drum opposing wall part 47 is formed to be thinner than a lower portion and an outer surface thereof is inwardly stepped. When the upper frame 42 is assembled to the lower frame 41, the left sidewall 61 and the right sidewall 62 are opposed to the outer surfaces of the upper portions of the drum opposing wall parts 47 while being in contact therewith, and the outer surfaces of the left sidewall 61 and the right sidewall 62 are substantially flush with the outer surfaces of the lower portions of the drum opposing wall parts 47.

the left sidewall 61 and the right sidewall 62 are respectively formed with outside drum shaft insertion penetration holes 65, 66 into which a drum shaft 72, which will be described later, is inserted. In addition, the drum opposing wall part 47 of the left sidewall 43 of the lower frame 41 is formed at a position opposite the outside drum shaft insertion penetration hole 65 with an inside drum shaft insertion penetration hole 56 into which the drum shaft 72 is inserted. Meanwhile, the drum opposing wall part 47 of the right sidewall 44 of the lower frame 41 is formed at a position opposed to the outside drum shaft insertion penetration hole 66 with an inside drum shaft insertion penetration hole 57 into which the drum shaft 72 is inserted.

As shown in FIG. 7, the rear wall 63 is built between the rear end edges of the left sidewall 61 and the right sidewall 62. The charger 11 is held on a front surface (inner surface) of the rear wall 63.

Figure 4:
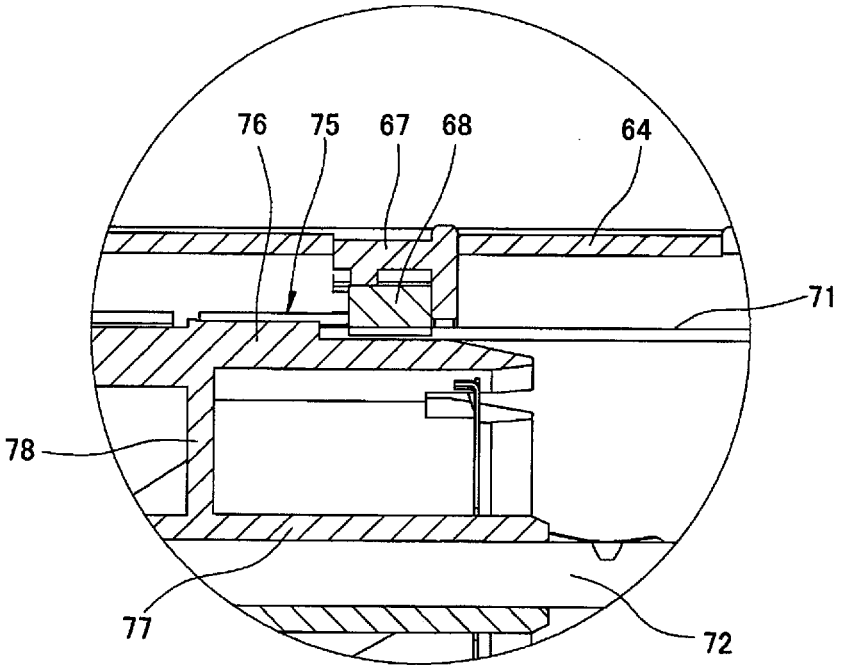
FIG. 4 is an enlarged sectional view of a part surrounded by a circle shown in FIG. 3.

As shown in FIG. 6, the ceiling wall 64 extends forward from an upper end edge of the rear wall 63. Both end portions of a lower surface of the ceiling wall 64 are formed with contact member adhering parts 67, as shown in FIGS. 4 and 7. Each of the contact member adhering parts 67 has a front end portion having a circular arc section about the rotational axis line 10 of the photosensitive drum 9. A lower surface of the front end portion is an example of a circular arc surface.

Each contact member adhering part 67 is adhered with a contact member 68 made of an elastic material such as urethane foam. As shown in FIG. 6, the contact member 68 is curved into a circular arc shape along the contact member adhering part 67, when seen from a side face.

In addition, the lower surface of the ceiling wall 64 is formed at positions abutting on inner sides (a right side of the left contact member adhering part 67 and a left side of the right contact member adhering part 67) of the contact member adhering parts 67 with rib-shaped contact preventing parts 69 that protrude downwardly from the ceiling wall 64, as shown in FIGS. 4 and 7. The contact preventing parts 69 have a plate shape extending in the front-rear direction, respectively.

(3) Photosensitive Drum

When the upper frame 42 is assembled to the lower frame 41, a space defined by the lower frame 41 and the upper frame 42 is opened forward and the photosensitive drum 9 is arranged in the space.

As shown in FIG. 3, the photosensitive drum 9 has a cylindrical drum main body 71 and a drum shaft 72 that extends along a central axis line of the drum main body 71.

The drum main body 71 is made of a conductive material such as aluminum. A positively charged photosensitive layer made of polycarbonate and the like is formed on a circumferential surface of the drum main body 71.

The drum shaft 72 is made of a metal rod. A left end portion of the drum shaft 72 is inserted into the inside drum shaft insertion penetration hole 56 of the lower frame 41 and the outside drum shaft insertion penetration hole 65 of the upper frame 42 and is fixed to the upper frame 42 by a fixture 73. In the meantime, a right end portion of the drum shaft 72 is inserted into the inside drum shaft insertion penetration hole 57 of the lower frame 41 and the outside drum shaft insertion penetration hole 66 of the upper frame 42 and is fixed to the upper frame 42 by a fixture 74. Thereby, the drum shaft 72 is supported to the frame 8 so that it cannot be rotated.

A left flange member 75 is pressed in the left end portion of the drum main body 71. The left flange member 75 integrally has a cylindrical inside fitting part 76 that is fitted in the drum main body 71 so that it cannot be relatively rotated, a shaft insertion penetration part 77 that has a cylindrical shape having a central axis line identical to the inside fitting part 76 and into which the drum shaft 72 is inserted to be relatively rotatable and a connection part 78 that connects the inside fitting part 76 and the shaft insertion penetration part 77.

A right flange member 79 is pressed in the right end portion of the drum main body 71. The right flange member 79 integrally has a cylindrical inside fitting part 80 that is fitted in the drum main body 71 so that it cannot be relatively rotated, a shaft insertion penetration part 81 that has a cylindrical shape having a central axis line identical to the inside fitting part 80 and into which the drum shaft 72 is inserted to be relatively rotatable and a connection part 82 that connects a central portion of the left-right direction of the inside fitting part 80 and the shaft insertion penetration part 81.

The drum shaft 72 is rotatably inserted into the shaft insertion penetration part 77 of the left flange member 75 and the shaft insertion penetration part 81 of the right flange member 79. Further, the left flange member 75 and the right flange member 79 are rotatably supported by the drum shaft 72, so that the drum main body 71 is rotatably supported by the drum shaft 72 through the left flange member 75 and the right flange member 79.

When the photosensitive drum 9 is mounted to the frame 8, the contact members 68 are pressure-contacted to both end portions of the drum main body 71. In other words, the contact members 68 are interposed between the circumferential surface of both end portions of the drum main body 71 and the contact member adhering parts 67 while being compressed. More specifically, the circumferential surface of the drum main body 71 has an image forming area A1 on which an electrostatic latent image is formed and non-image forming areas A2 that are adjacent to both sides in the left-right direction of the image forming area A1 and on which an electrostatic latent image is not formed. The contact members 68 are interposed between the non-image forming areas A2 and the contact member adhering parts 67 while being compressed and are surface-contacted to the non-image forming areas A2. In addition, a length from the lower surface of the ceiling wall 64 to a leading edge of the contact preventing part 69 is smaller than a gap between the ceiling wall 64 and the circumferential surface of the drum main body 71, so that the contact preventing parts 69 do not contact the circumferential surface of the drum main body 71.

In addition, a press member 83 is provided to a right side of the right flange member 79. The press member 83 integrally has a disc part 84 and a cylindrical part 85 that protrudes from a left side of the disc part 84 toward the interior of the inside fitting part 80 of the right flange member 79. The disc part 84 is formed at its central portion with a penetration hole into which the drum shaft 82 is inserted. This penetration hole has a diameter greater than the drum shaft 72, so that the drum shaft 72 is not contacted to the disc part 84. The cylindrical part 85 is fitted in the inside fitting part 80 of the right flange member 79 so that it can be slidingly moved and cannot be relatively rotated.

A coil spring 86 is mounted in the cylindrical part 85 of the press member 83. The coil spring 86 presses the press member 83 rightward. A frictional member 87 made of felt is arranged at a part of the lower frame 41, which is opposed to the press member 83. The disc part 84 of the press member 83 is pressure-contacted to the frictional member 87 by the pressing force of the coil spring 86.

3. Operational Effects (1) Operational Effect 1

As described above, the photosensitive drum 9 is rotatably supported by the frame 8 of the drum unit 6 and the contact members 68 that are surface-contacted to the circumferential surface of the photosensitive drum 9 are held. The circumferential surface of the photosensitive drum 9 has the image forming area A1 on which an electrostatic latent image is formed and the non-image forming areas A2 that are adjacent to the image forming area A1. The contact members 68 are not contacted to the image forming area A1 and are surface-contacted to the non-image forming areas A2.

When the photosensitive drum 9 is rotated, the contact members 68 are slidingly friction-contacted to the non-image forming areas A2 of the circumferential surface of the photosensitive drum 9. Thereby, frictional force is applied to the circumferential surface of the photosensitive drum 9 from the contact members 68 and serves as resistance to the rotation of the photosensitive drum 9. Accordingly, the photosensitive drum 9 is rotated with weak braking force being always applied (with braking being weakly applied at all times). As a result, a change in the rotational speed of the photosensitive drum 9 is suppressed.

Since the contact members 68 are mounted at the positions opposed to the circumferential surface of the photosensitive drum 9, it is not necessary to retract the contact members 68 from the space in which the photosensitive drum 9 is arranged, when mounting the photosensitive drum 9 to the frame. Accordingly, it is possible to easily mount the photosensitive drum 9 to the frame.

Accordingly, it is possible to suppress the change in the rotational speed of the photosensitive drum 9 while easily mounting the photosensitive drum 9 to the frame.

In addition, since it is not necessary to provide a space for arranging the contact members 68 at both sides of the photosensitive drum 9, it is possible to reduce the size in the left-right direction of the photosensitive drum 9.

Furthermore, the contact parts between the contact members 68 and the photosensitive drum 9 are set on the circumferential surface away from the rotational axis line of the photosensitive drum 9. Hence, it is possible to effectively apply the frictional force to the photosensitive drum 9 from the contact members 68 with smaller force, compared to a configuration in which the contact parts are set at positions close to the rotational axis line of the photosensitive drum 9.

(2) Operational Effect 2

The non-image forming areas A2 are provided at both sides of the image forming area A1. The plurality of contact members 68 (two contact members in this illustrative embodiments) is provided and surface-contacted to the respective non-image forming areas A2. Accordingly, it is possible to apply well balanced frictional force from the contact members 68 to the photosensitive drum 9. As a result, it is possible to prevent one end portion in the left-right direction of the photosensitive drum 9 from being rotated slightly later than the other end portion, and thus the photosensitive drum 9 can rotate stably.

(3) Operational Effect 3

In addition, the charger 11 for charging the circumferential surface of the photosensitive drum 9 is held to the frame 8. The developing unit mounting part 13, to which the developing unit 7 for developing the electrostatic latent image into a developer image is mounted, is formed at the opposite side of the charger 11 with respect to the photosensitive drum 9 of the frame 8, i.e., at the front of the photosensitive drum 9. Thus, the charger 11 is arranged at the rear of the photosensitive drum 9 and the developing unit mounting part 13 is formed at the front i.e. the opposite side of the photosensitive drum 9. Accordingly, compared to a configuration in which the charger 11 is arranged at the upper side of the photosensitive drum 9, it is possible to further reduce a size of the upper-lower direction of the drum unit 6 (i.e., it is possible to make the drum unit 6 thinner).

(4) Operational Effect 4

The frame 8 has the ceiling wall 64 that extends from the position opposed to the charger 11 toward the developing unit mounting part 13 and is opposed to the circumferential surface of the photosensitive drum 9 and separated by an interval. Thus, it is possible the ceiling wall 64 prevents the circumferential surface of the photosensitive drum 9 from being exposed from the frame 8.

(5) Operational Effect 5

The contact members 68 are held to the ceiling wall 64 and are interposed between the ceiling wall 64 and the circumferential surface of the photosensitive drum 9. In other words, although it is preferable to reduce a thickness of the ceiling wall 64 itself so as to make the drum unit 6 thinner, it is difficult to secure the strength of the ceiling wall 64 with the reduced thickness. Even when the thickness of the ceiling wall 64 is small enough to cause flexural deformation, the contact members 68 are interposed between the ceiling wall 64 and the circumferential surface of the photosensitive drum 9, so that it is possible to prevent the ceiling wall 64 from being contacted to the circumferential surface of the photosensitive drum 9 due to the flexural deformation. Accordingly, it is possible to make the drum unit 6 thinner and to prevent the damage of the circumferential surface of the photosensitive drum 9 due to the contact with the ceiling wall 64.

(6) Operational Effect 6

Furthermore, the ceiling wall 64 is formed with the contact preventing parts 69 at the positions adjacent to the contact members 68. The contact preventing parts 69 extend from the ceiling wall 64 toward the circumferential surface of the photosensitive drum 9 and the length thereof is smaller than the gap between the ceiling wall 64 and the circumferential surface of the photosensitive drum 9. Therefore, the contact preventing parts 69 are not normally contacted to the circumferential surface of the photosensitive drum 9 and are prevented from being contacted to the circumferential surface of the photosensitive drum 9 due to the flexural deformation of the ceiling wall 64 by the contact members 68 surface-contacting the circumferential surface of the photosensitive drum 9. When the ceiling wall 64 is flexural-deformed to a non-absorbable degree by the compression of the contact members 68, the contact preventing parts 69 contact the non-image forming areas A2 of the circumferential surface of the photosensitive drum 9, so that further flexural deformation of the ceiling wall 64 is hindered. Accordingly, it is possible to securely prevent the ceiling wall 64 from contacting the circumferential surface of the photosensitive drum 9.

In other words, in order to securely prevent the ceiling wall 64 from contacting the photosensitive drum 9, it is preferable that the contact preventing parts 69 having greater rigidity than the contact members 68 to the photosensitive drum 9. However, when the contact preventing parts 69 having such rigidity are made to always contact the photosensitive drum 9, the photosensitive drum 9 may be worn. According to the above configuration, the contact members 68 are in contact with the circumferential surface of the photosensitive drum 9 at normal times and the contact preventing parts 69 are in contact with the circumferential surface of the photosensitive drum 9 only at abnormal times (for example, only when the ceiling wall 64 is highly flexural-deformed by some external forces). Thereby, it is possible to reduce the wear of the photosensitive drum 9 and to securely prevent the ceiling wall 64 from contacting the surface of the photosensitive drum 9.

(7) Operational Effect 7

In addition, the contact members 68 are interposed between the ceiling wall 64 and the circumferential surface of the photosensitive drum 9 while being compressed. Accordingly, the contact members 68 are surface-contacted to the circumferential surface of the photosensitive drum 9 with appropriate pressing force by the restoring force of the contact members 68. As a result, it is possible to apply the appropriate frictional force to the circumferential surface of the photosensitive drum 9 with the contact members 68 and thus suppress the change in the rotational speed of the photosensitive drum 9.

(8) Operational Effect 8

The transfer roller 12 for transferring a toner image formed on the circumferential surface of the photosensitive drum 9 to the sheet P is held to the frame 8. The transfer roller 12 is arranged so that it contacts the photosensitive drum 9 from opposite sides of the contact members 68. Therefore, it is possible to support the pressing force that is applied to the circumferential surface of the photosensitive drum 9 from the contact members 68 by the transfer roller 12, so that it is possible to use the pressing force to prevent the photosensitive drum 9 from being deviated.

(9) Operational Effect 9

In addition, the ceiling wall 64 is formed with the contact member adhering parts 67 having the circular arc surfaces about the rotational axis line of the photosensitive drum 9. The contact members 68 are fixed to the contact member adhering parts 67. Accordingly, the contact members 68 are uniformly surface-contacted to the circumferential surface of the photosensitive drum 9 in the circumferential direction. Thus, it is possible to favorably apply the frictional force from the contact members 68 to the circumferential surface of the photosensitive drum 9 and thus to further suppress the change in the rotational speed of the photosensitive drum 9.

(10) Operational Effect 10

Additionally, the press member 83 is mounted to the right side of the right flange member 79 and is pressure-contacted to the frictional member 87 by the pressing force of the coil spring 86. Thereby, when the photosensitive drum 9 (drum main body 71) is rotated, the frictional force is applied from the frictional member 87 to the press member 83. As a result, it is possible to suppress the change in the rotational speed of the photosensitive drum 9.

4. Modified Illustrative Embodiments

While the present invention has been shown and described with reference to certain illustrative embodiments thereof, it will be understood by those skilled in the art that various changes in form and details may be made therein without departing from the spirit and scope of the invention as defined by the appended claims.

For example, the inventive concept of the present invention can also be applied to a color printer.

In the above illustrative embodiment, the drum unit 6 and the developing unit 7 are separately configured (the developing unit 7 is detachably mounted to the drum unit 6). However, the drum unit 6 and the developing unit 7 may be integrated.

What is claimed is:

1. A drum unit comprising:

a frame;

a photosensitive drum that is rotatably supported by the frame, wherein the photosensitive drum includes a circumferential surface having an image forming area on which an electrostatic latent image is configured to be formed and a non-image forming area that is adjacent to the image forming area in a rotational axis line direction of the photosensitive drum;

a contact member that is held to the frame and made of urethane foam, and that is configured to contact the non-image forming area and configured to not contact the image forming area;

wherein the frame includes:

a wall extending in the rotational axis line direction of the photosensitive drum, the wall including:

a base, an adhering part protruding from the base toward the circumferential surface of the photosensitive drum, the adhering part being adhered with the contact member, and a preventing part protruding from the adhering part toward the circumferential surface of the photosensitive drum, the preventing part having a rib shape, the preventing part positioned closer to a center of the photosensitive drum in the rotational axis line direction than the adhering part, the preventing part being spaced from the photosensitive drum, wherein the preventing part abuts on the contact member in the rotational axis line direction of the photosensitive drum.

2. The drum unit according to claim 1, wherein the non-image forming area is formed on both sides of the image forming area with respect to the rotational axis line direction of the photosensitive drum, and wherein a plurality of contact members are provided, and each of the plurality of contact members is in contact with a respective one of the non-image forming areas.

3. The drum unit according to claim 2, wherein the preventing part is disposed between the plurality of contact members in the rotational axis line direction of the photosensitive drum.

4. The drum unit according to claim 1, further comprising:

a charger that is held to the frame and that is configured to charge the circumferential surface of the photosensitive drum; and a developing unit mounting part that is formed on a side of the frame opposite to the charger with respect to the photosensitive drum, wherein the developing unit is mountable to the developing unit mounting part.

5. The drum unit according to claim 4, wherein the wall extends toward the developing unit mounting part from a position opposed to the charger, and wherein the wall is opposed to the circumferential surface of the photosensitive drum and separated by an interval.

6. The drum unit according to claim 5, wherein the contact member is interposed between the wall and the circumferential surface of the photosensitive drum and is in contact with the non-image forming area.

7. The drum unit according to claim 6, wherein the preventing part has a length that is smaller than a gap formed between the wall and the circumferential surface of the photosensitive drum in a direction in which the wall opposes the photosensitive drum.

8. The drum unit according to claim 6, wherein the contact member is interposed between the wall and the circumferential surface of the photosensitive drum while being compressed.

9. The drum unit according to claim 8, further comprising:

a transfer roller attached to the frame, the transfer roller being in contact with the photosensitive drum from an opposite side of the contact member, and the transfer roller being configured to transfer a developer image formed on the circumferential surface of the photosensitive drum to a medium.

10. The drum unit according to claim 6, wherein the adhering part of the wall has a circular arc surface having an arc shape centered about the rotational axis line direction of the photosensitive drum, and wherein the contact member is attached to the circular arc surface.

11. The drum unit according to claim 1, wherein the preventing part is entirely interposed between the circumferential surface of the photosensitive drum and the frame.

12. The drum unit according to claim 1, wherein a reference line parallel to the rotational axis line direction of the photosensitive drum intersects the contact member and the preventing part.

13. The drum unit according to claim 12, wherein a second reference line perpendicular to the rotational axis line direction of the photosensitive drum intersects the preventing part and the photosensitive drum.

14. The drum unit according to claim 1, wherein a length of the contact member is larger than a length of the preventing part in the rotational axis line direction of the photosensitive drum.

15. The drum unit according to claim 1, wherein a length of the preventing part in the rotational axis line direction of the photosensitive drum is larger than a length of the preventing part in a direction perpendicular to the rotational axis line direction.

* * * * *